US006591654B2

(12) United States Patent
Kwok

(10) Patent No.: US 6,591,654 B2
(45) Date of Patent: Jul. 15, 2003

(54) METHOD FOR PRODUCING SEAMLESS HOLLOW EXTRUDED PRODUCTS OF ALUMINUM ALLOY AND DIE SET THEREFOR

(76) Inventor: Lai Yee Kwok, Block D G/F., Phase One, Hung Cheong Ind. Centre, 12 Tsing Yeung Circuit, Tuen Mun, N.T., Hong Kong (CN)

( * ) Notice: Subject to any disclaimer, the term of this patent is extended or adjusted under 35 U.S.C. 154(b) by 19 days.

(21) Appl. No.: 09/837,781

(22) Filed: Apr. 18, 2001

(65) Prior Publication Data

US 2002/0029601 A1 Mar. 14, 2002

(30) Foreign Application Priority Data

Sep. 12, 2000 (CN) ..... 00126375 A

(51) Int. Cl.[7] ..... B21C 25/04
(52) U.S. Cl. ..... 72/269; 72/467
(58) Field of Search ..... 72/253.1, 264, 72/269, 271, 467

(56) References Cited

U.S. PATENT DOCUMENTS 2,368,355 A * 1/1945 Guiney ..... 72/269
2,638,213 A * 5/1953 Clark ..... 72/269
3,777,544 A * 12/1973 Alexandrov et al. ..... 72/269
5,061,163 A * 10/1991 Kennedy ..... 72/269

FOREIGN PATENT DOCUMENTS

| | | | | |
|---|---|---|---|---|
| JP | 2-20614 | * | 1/1990 | 72/269 |
| SU | 617098 | * | 7/1978 | 72/269 |
| SU | 912317 | * | 3/1982 | 72/269 |

* cited by examiner

*Primary Examiner*—Ed Tolan
(74) *Attorney, Agent, or Firm*—Alix, Yale & Ristas, LLP

(57) ABSTRACT

An extrusion die set includes a charging die and forming die that permit the extrusion of seamless hollow products from a solid billet of aluminum or aluminum alloy on a single cylinder horizontal extrusion press. The charging die imparts a rotational component to the portions of a divided extrusion charge. The portions are combined in a zone of high pressure and further blended in a mixing space having a continuously variable configuration in the extrusion direction. The portions of the extrusion charge are so thoroughly blended that the hollow products have an uninterrupted molecular and crystalline configuration.

15 Claims, 8 Drawing Sheets

METHOD FOR PRODUCING SEAMLESS HOLLOW EXTRUDED PRODUCTS OF ALUMINUM ALLOY AND DIE SET THEREFOR

BACKGROUND OF THE INVENTION

1. Field of the Invention

The invention relates to a hot extrusion process for aluminum alloy, and more particularly to a method and mold group for producing seamless pipe sections of aluminum alloy using a horizontal single-cylinder extrusion press.

2. Description of the Related Art

Hot extrusion involves pushing a heated billet of metal through a die. The extruded product may be hollow or solid, and the cross section may vary from a simple round to a complicated shape. Direct extrusion, wherein the metal is forced under pressure through a die opening of the desired cross-sectional area and shape is the most common form of extrusion. The die is typically located in the end of a cylinder opposite a hydraulic ram.

The extrusion of products having a hollow cross section is complicated by the necessity to form the internal and external configuration of the part simultaneously. The portion of an extrusion die used to define the interior of a hollow extrusion is typically called a mandrel. The mandrel must be rigidly supported within the die to accurately define the interior configuration of the hollow extrusion.

The most common and least expensive type of extrusion equipment is the single-cylinder horizontal extrusion press. In such a press, a heated billet of metal is deposited in a cylinder where a ram forces the hot metal through an extrusion die at one end of the cylinder. Hollow products can be extruded on such a press by using a die in which the mandrel is supported within the die by a rigid connection or connections to an outer portion of the die. Such bridge, porthole and spider-type dies are widely used in the extrusion of hollow shapes from aluminum and aluminum alloy. In these types of dies (all modifications of the same basic construction), the metal billet is divided by the mandrel supports during extrusion and is forced back together as the metal "charge" passes through the remainder of the die and the die extrusion orifice. The metal welds under heat and pressure to form an apparently unitary hollow extruded product.

The two components of such a die are illustrated in FIG. 3 (mandrel supports not shown). The resulting extruded product, while appearing seamless in fact includes a weld seam or interruption of the molecular/crystalline structure of the metal wherever the material was forced to divide at a mandrel support. The presence of these imperfections at the molecular level can be confirmed by cutting across a pipe produced by such a method, polishing the cross-sectional surface to a high mirror finish, corroding the pipe in an alkali chemical agent heated to a temperature of 70–80° C. for 10–15 minutes and then cleaning the pipe with water. The weld lines can then be clearly identified and appear in a configuration illustrated in FIG. 1.

A hollow extruded product having such structural imperfections does not have the structural integrity of a true seamless product. Typically, the seamed hollow product will fail along the weld lines or crystal interruptions when exposed to high internal pressure or large compressive loads. Therefore, such products are not widely used in industry in spite of the fact that there is great demand for hollow aluminum products in the manufacturing field. Seamless hollow tubular products, because of their strength and integrity are used to form tubular structural assemblies such as bicycle frames and are also able to withstand internal pressure and have improved corrosion resistance and are therefore in high demand for the aeronautics and food service industries.

Several methods are known in the art for producing seamless pipe sections of aluminum and aluminum alloy. FIG. 4 illustrates an apparatus for the centrifugal casting of seamless aluminum pipe sections. In this method, molten aluminum is poured into a mold that is rotated at high speed to form cast-aluminum seamless pipe sections of high integrity.

FIG. 5 is a functional block diagram of the equipment necessary for casting round aluminum rods. After the aluminum is melted in an oven 5-1, the melted aluminum passes into an insulated purifying oven 5-3 through a channel 5-2 where the aluminum is purified in an inert atmosphere. The purified molten aluminum then passes through an outlet 5-4 into a facility 5-5, 5-6 for producing solid aluminum rod by a water-cooled cooled continuous casting method. To form a seamless hollow tube, the solid rod must now be machined as is illustrated in FIG. 6.

FIG. 7 illustrates a more advanced method involving the continuous horizontal casting of pipe sections. In this process, after being melted in an oven 7-1, the molten aluminum flows into an insulated purifying oven 7-3 and then through a high-pressure water-cooled type graphite mold 7-4. The emerging tubular product is gripped by a tension-slip mechanism 7-5 that pulls the emerging product away from the graphite mold. While the tubular product is being pulled away from the mold, it is carefully cooled using high-pressure water. The process takes place from right to left in FIG. 7 with the molten aluminum emerging from the purifying oven 7-3 by force of gravity to flow through the graphite mold.

In a sophisticated extrusion process, illustrated in FIG. 8, two rams are used. After a first ram (sometimes called a floating mandrel) pierces the billet a second ram pressurizes the now hollow billet and forces the aluminum out of a die where the first ram/mandrel forms the internal configuration of the extruded product.

There are several disadvantages to the methods for producing seamless pipe sections of aluminum or aluminum alloy illustrated in FIGS. 4–8. The method of FIG. 4 requires the use of expensive centrifugal casting equipment and is limited to the production of pipe sections having a circular cross section. The method illustrated in FIG. 5 and FIG. 6 involves the expensive step of machining illustrated in FIG. 6 and results in excessive waste, i.e., material removed to form the bore of the tubing. The method of FIG. 5 and FIG. 6 is also limited to producing circular tubing. The method illustrated in FIG. 7 requires the use of expensive and not readily available continuous casting equipment.

Additionally, the methods illustrated in FIGS. 4–7 result in a cast-aluminum product in which the molecular structure, surface finish and dimensional tolerances require correction prior to use. Cast pipe sections are typically subjected to cold rolling as illustrated in FIGS. 9 and 10. These processes result in an increased molecular density on the surface of the tubing. It may also be necessary to use mechanical processes to reduce the wall thickness of the cast tubing.

Such cold working results in internal stresses in the crystal structure of the cast pipe sections. Therefore, the pipe sections must be heat treated to relieve these internal stresses as illustrated in FIG. 11 and avoid the hairline fractures of the tubing caused by such stresses. The heat treating process, while relieving the internal crystal stresses, typically results in pipe sections which are no longer straight or true. To produce straight pipe sections, each section must now be drawn through a stretching mill as illustrated in FIG. 12. The pipes are drawn through a tungsten carbide alloy mold with a straight stretching machine from which the seamless pipe sections emerge having a precision configuration which meets manufacturing tolerances. Following stretching, another annealing or heat-treating process must be done. The stretching process may be repeated with new tungsten carbide molds to further alter the configuration of the pipe sections.

Each step required to produce acceptable seamless pipe sections of aluminum or aluminum alloy adds to the complexity, expense and production losses of the process. While the method illustrated in FIG. 8 is relatively more advanced, the equipment is expensive, the process consumes a high amount of power and the technical requirements for achieving a tubular product having acceptable concentricity are high.

As a result, the prior art methods for producing seamless pipe sections of aluminum or aluminum alloy illustrated in FIGS. 4–12 result in an overall final product rate of not more than 70% (i.e. 30% waste). These factors result in very high production costs for acceptable seamless pipe sections of aluminum or aluminum alloy.

SUMMARY OF THE INVENTION

An extrusion die set in accordance with the present invention includes a charging die and a forming die configured to mate together and define an axially continuous, substantially tubular charge flow passage.

A preferred embodiment of the charging die includes a plurality of substantially identical charge distribution passages symmetrically arranged around an axis. Each charge distribution passage extends from an inlet to an angularly and radially offset outlet. Each charge distribution passage has a continuously variable internal configuration where the cross sectional area of the outlet is larger than the cross sectional area of the inlet. The charging die rigidly supports a mandrel at the mandrel end of an axially extending mixing extension having an opposed charging end. The mixing extension is supported at the charging end by webs of die material defined between said charge distribution passages. The mixing extension tapers from a maximum diameter adjacent the charge distribution passage outlets to a minimum diameter adjacent the integrally supported mandrel.

The forming die defines an axial opening configured to receive the mixing extension and mandrel. The internal configuration of the forming die cooperates with the external configuration of the mixing extension and mandrel to define a charge flow passage having several distinct portions. A mixing chamber in communication with the charge distribution outlets is defined by an outside surface and pressure surface within the forming die. An annular exit to the mixing chamber is defined between a pressure shoulder on the pressure surface and the outside or mixing surface of the mixing extension. A mixing space is defined beyond the annular exit in the extrusion direction by the inside surface of a tapering mixing cone inside the forming die and the mixing surface of the axially extending mixing extension. This mixing space has a continuously variable configuration in the extrusion direction due to the differing angular orientations of the inside surface and the mixing surface. The mixing space terminates in an extrusion orifice defined between the mandrel and a forming ring in the forming die.

A billet is forced through the die set from the charge distribution passage inlets and eventually through the extrusion orifice in an extrusion direction. A rotational component is imparted to the charge portions as they pass through the arcuate charge distribution passages into the mixing chamber. In the mixing chamber the charge portions are combined by being forced, under high pressure, through the restrictive annular exit. The now substantially combined extrusion charge is further blended in the continuously variable mixing space and finally extruded as a seamless hollow product.

An object of the invention is to provide a new and improved extrusion die set and method that permit the extrusion of seamless pipe sections of aluminum and aluminum alloy on a conventional horizontal single-cylinder extrusion press.

Another object of the invention is to provide an extrusion die set and method which permit the production of seamless pipe sections of aluminum and aluminum alloy not limited to round pipe cross sections.

A further object of the invention is to provide an extrusion die set for use in conjunction with a horizontal single-cylinder extrusion press that blends a divided billet so thoroughly during extrusion that the resulting extruded hollow product can be considered seamless.

DETAILED DESCRIPTION OF THE PREFERRED EMBODIMENT

Figure 1:
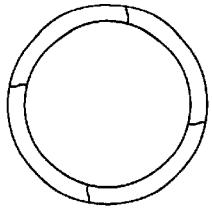
PRIOR ART Fig. 1
FIG. 1 is a cross sectional view of a tubular product formed by a prior art extrusion process.
Figure 2:
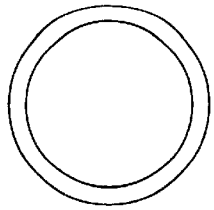
FIG. 2 is a cross sectional view of a seamless tubular product.
Figure 3:
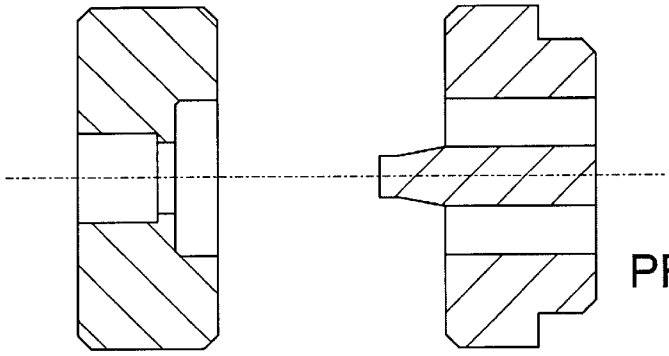
PRIOR ART Fig. 3
FIG. 3 is a sectional view of a prior art extrusion die set.
Figure 4:
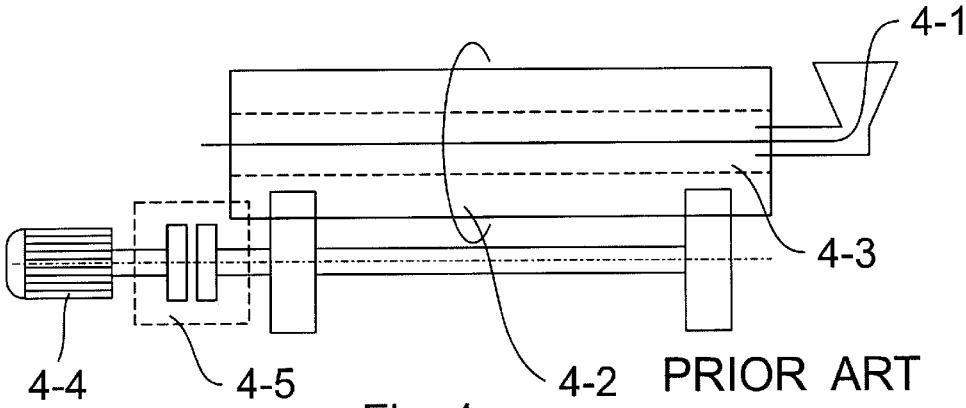
PRIOR ART Fig. 4
FIG. 4 is a schematic diagram illustrating a prior art centrifugal casting apparatus.
Figure 5:
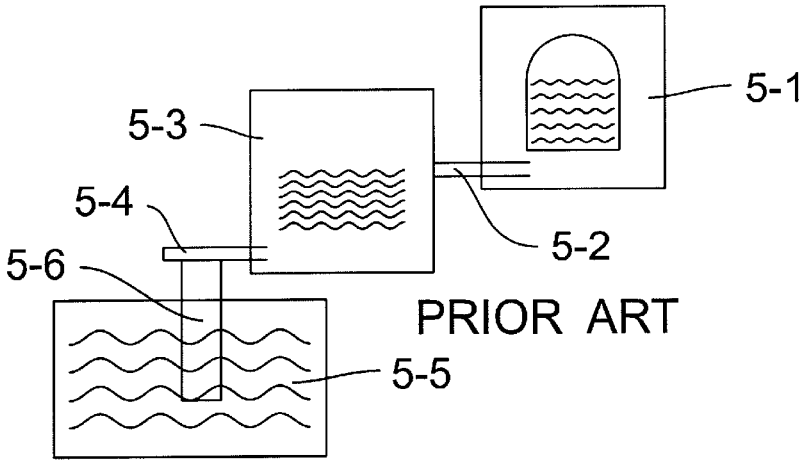
FIG. 5 is a schematic diagram illustrating the several steps of a prior art casting process.
Figure 6:
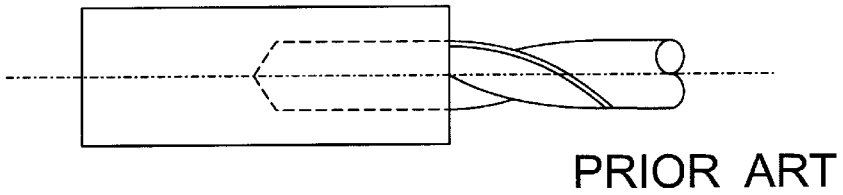
FIG. 6 is a diagram illustrating the production of a hollow product from a casting produced in FIG. 5.
Figure 7:
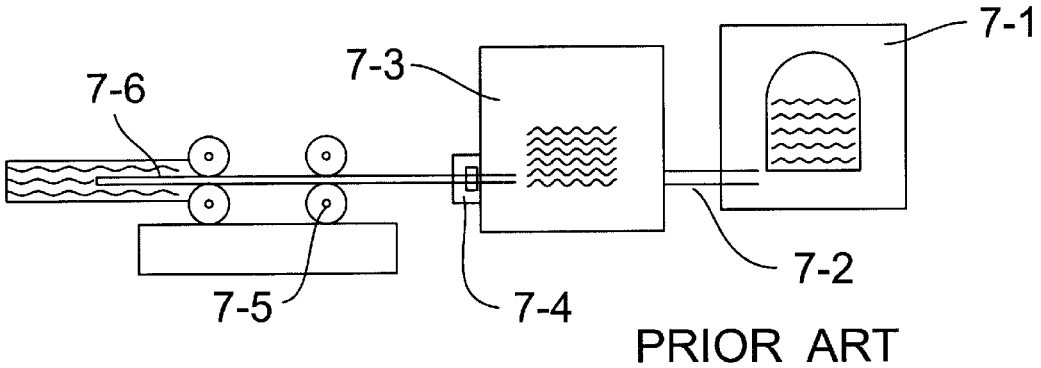
FIG. 7 is a schematic diagram illustrating the several steps of a prior art continuous casting process.
Figure 8:
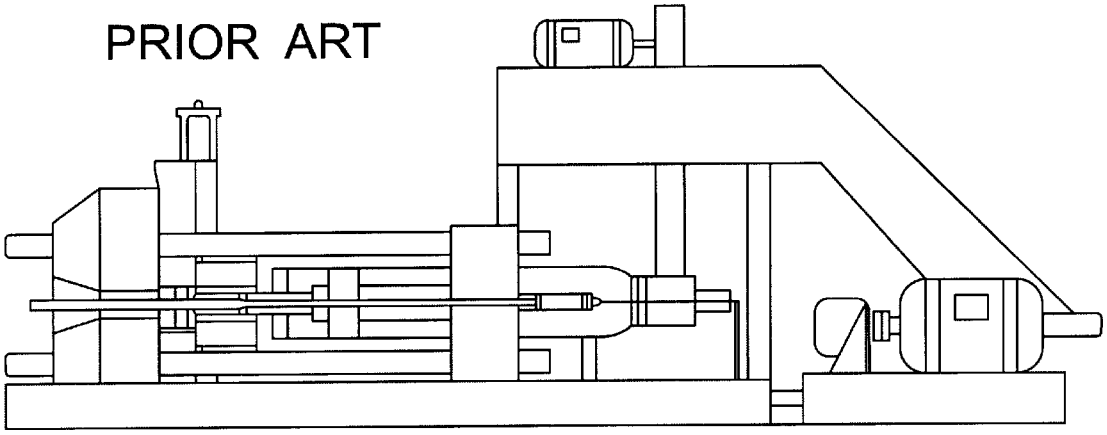
FIG. 8 is a schematic diagram, partially cut away, illustrating a prior art extrusion apparatus.
Figure 9:
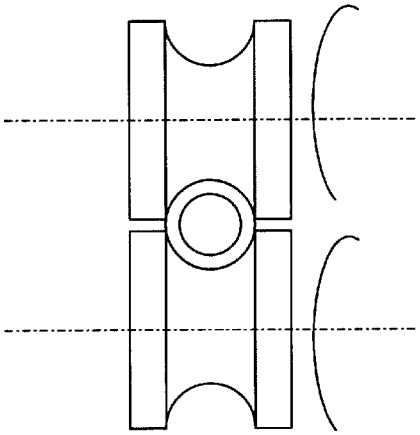
PRIOR ART Fig. 9
FIG. 9 is a partial illustration of a prior art cold rolling apparatus.
Figure 10:
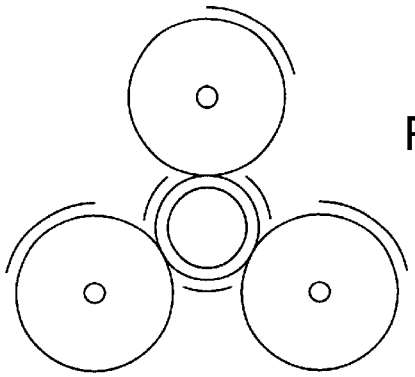
PRIOR ART Fig. 10
FIG. 10 is a partial illustration of a prior art cold rolling apparatus.
Figure 11:
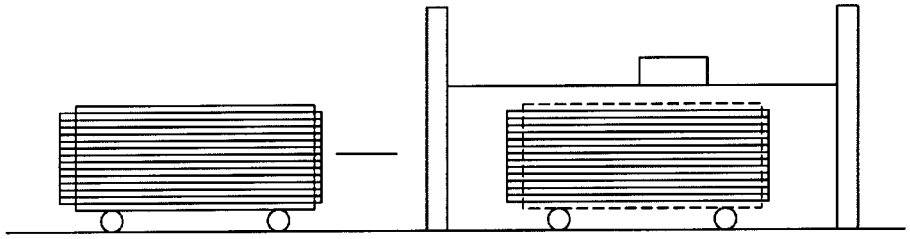
PRIOR ART Fig. 11
FIG. 11 is a cut away illustration of a prior art annealing furnace.
Figure 12:
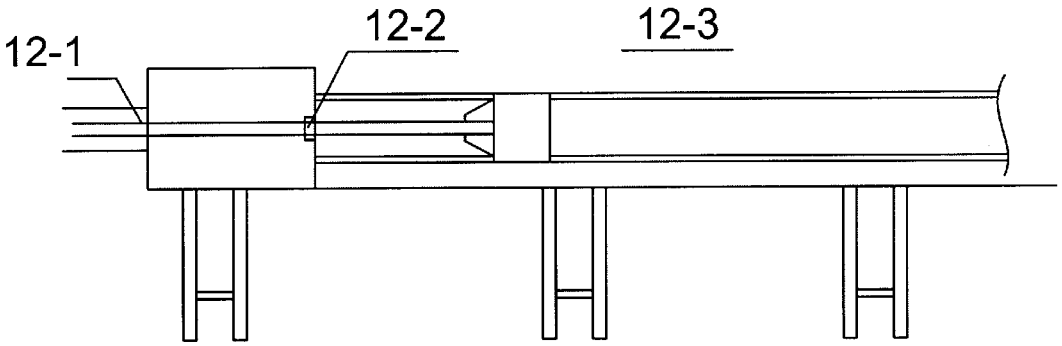
PRIOR ART Fig. 12
FIG. 12 is a schematic diagram, partially cut away, of a prior art tube stretching apparatus.

With reference to FIGS. 13–18 wherein like numerals represent like parts throughout the Figures, an extrusion die set in accordance with the present invention is designated by the numeral 10. A preferred embodiment of an extrusion die set in accordance with the present invention includes a charging die 1 and a forming die 2 mated together along a peripheral shoulder 6, 8. Axial arrows in FIGS. 13, 15 and 17 indicate a process direction from right to left. The mated die set 10 defines a continuous charge flow passage 7 in the process direction beginning at a plurality of charge distribution passage inlets 4 and extending through an extrusion orifice 40.

Figure 14:
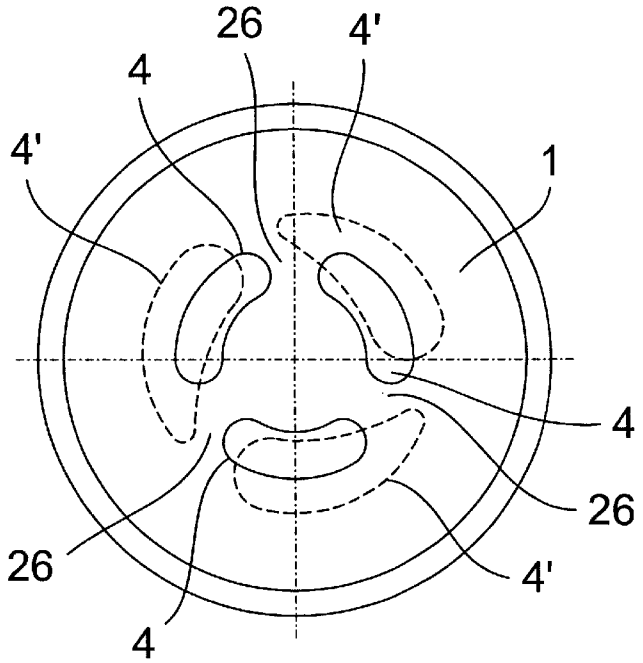
FIG. 14 is an end view, partially in phantom, of the extrusion die set of FIG. 13 turned 90° to the left.
Figure 16:
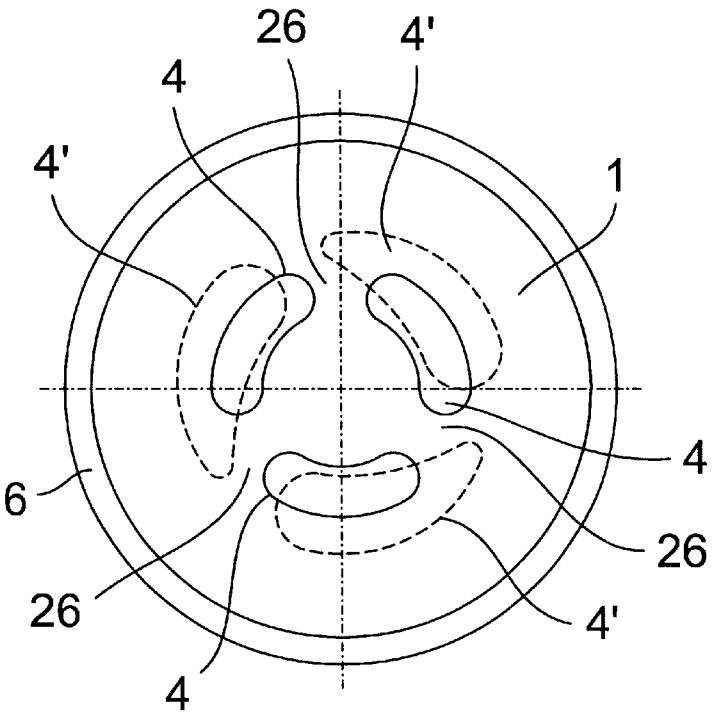
FIG. 16 is an end view, partially in phantom, of the charging die of FIG. 15 turned 90° to the left.
Figure 15:
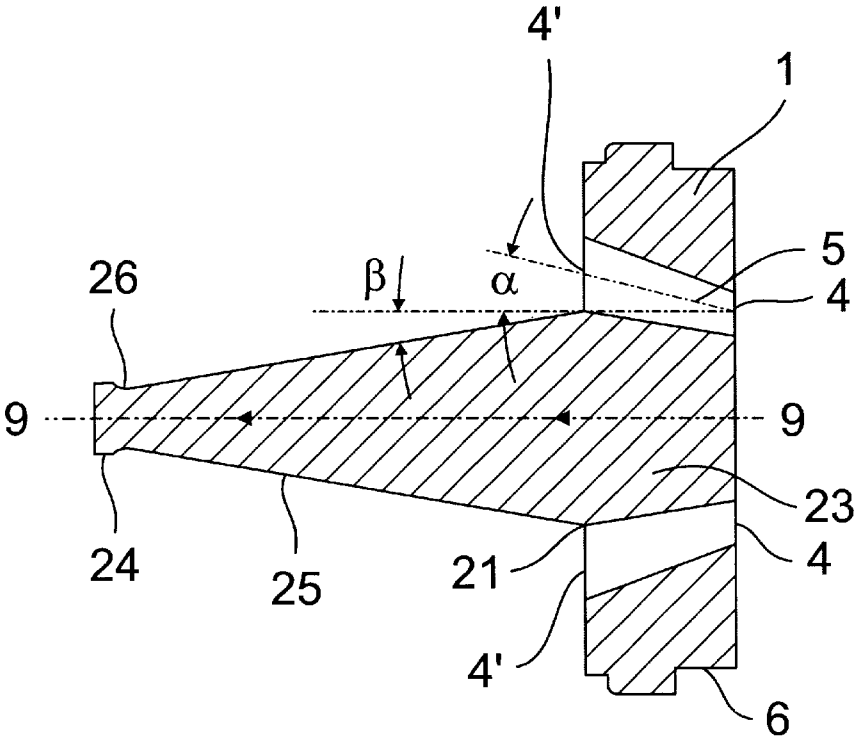
FIG. 15 is a sectional view through the center of a charging die in accordance with the present invention.

As is best seen in FIGS. 14 and 16, the charge flow passage 7 begins at inlet 4 of each charge distribution passage 5. In the illustrated preferred embodiment, three charge distribution passage inlets 4 are symmetrically arranged around a central axis 9. Each of the charge distribution passages 5 has the same configuration. Each charge distribution passage 5 extends from an inlet 4 to an angularly offset outlet 4'. The internal configuration of each charge distribution passage 5 changes from the symmetrical arcuate oval of the inlet 4 to the asymmetrical pointed ovoid of the outlet 4'. The configuration of the outlet 4' defines a larger surface area and, in the case of the preferred embodiment, extends the pointed end of the ovoid angularly in a counterclockwise direction. The resulting charge flow passage 5 has a continuously variable internal configuration and defines an arcuate path projecting counterclockwise around the central axis 9 in the process direction.

The charging die 1 also includes a centrally supported mixing extension 22 projecting in the process direction. Webs 26 of die material located between the charge distribution passages 5 support the mixing extension 22. The charge distribution passages 5 illustrated in the preferred embodiment not only change their shape and angular orientation from inlet 4 to outlet 4', but also project radially outwardly from inlet 4 to outlet 4'. Thus, the outside surface of the charging end 23 of the mixing extension 22 projects away from the central axis 9 at angle $\alpha$. The projecting portion 25 of the mixing extension 22 tapers at a constant rate from its widest point 21 to its narrowest point 26. The widest point 21 of the mixing extension 22 is located immediately adjacent the outlets 4' of the charge distribution passages 5. The narrowest point 26 of the mixing extension 22 is located at the junction of the mixing extension and the integrally extending mandrel 24. The mixing extension 22 tapers at an angle $\beta$ with respect to the central axis 9.

Figure 18:
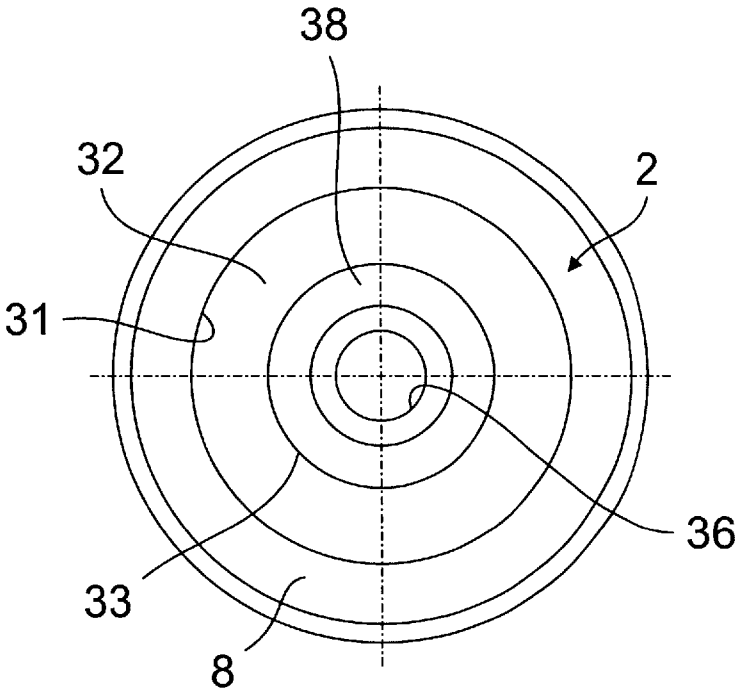
FIG. 18 is an end view of the forming die of FIG. 17 turned 90° to the left.
Figure 17:
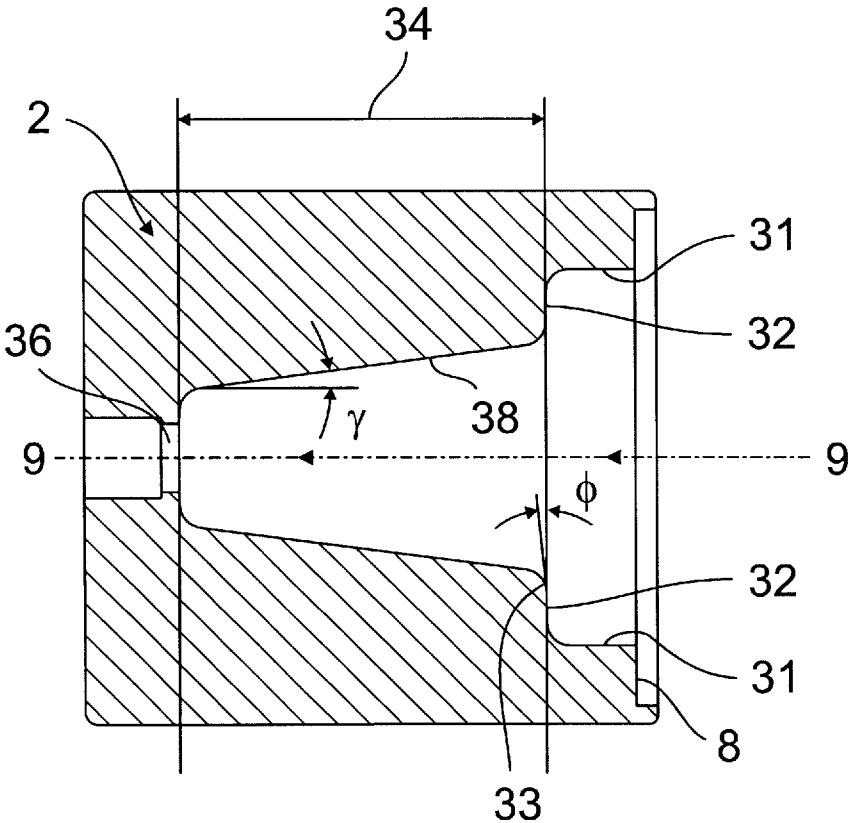
FIG. 17 is a sectional view through the center of a forming die in accordance with the present invention.

The charging die 1 is configured to mate with a forming die 2 illustrated in FIGS. 17 and 18. The forming die 2 defines an axial through space having several distinct portions. In the process direction, or from right to left of FIG. 17, a peripheral shoulder 8 is configured to mate with and surround the peripheral shoulder 6 located on the charging die 1. An outside wall 31 substantially parallel to the central axis 9 and a compression surface 32 partially define a mixing chamber 30.

Figure 13:
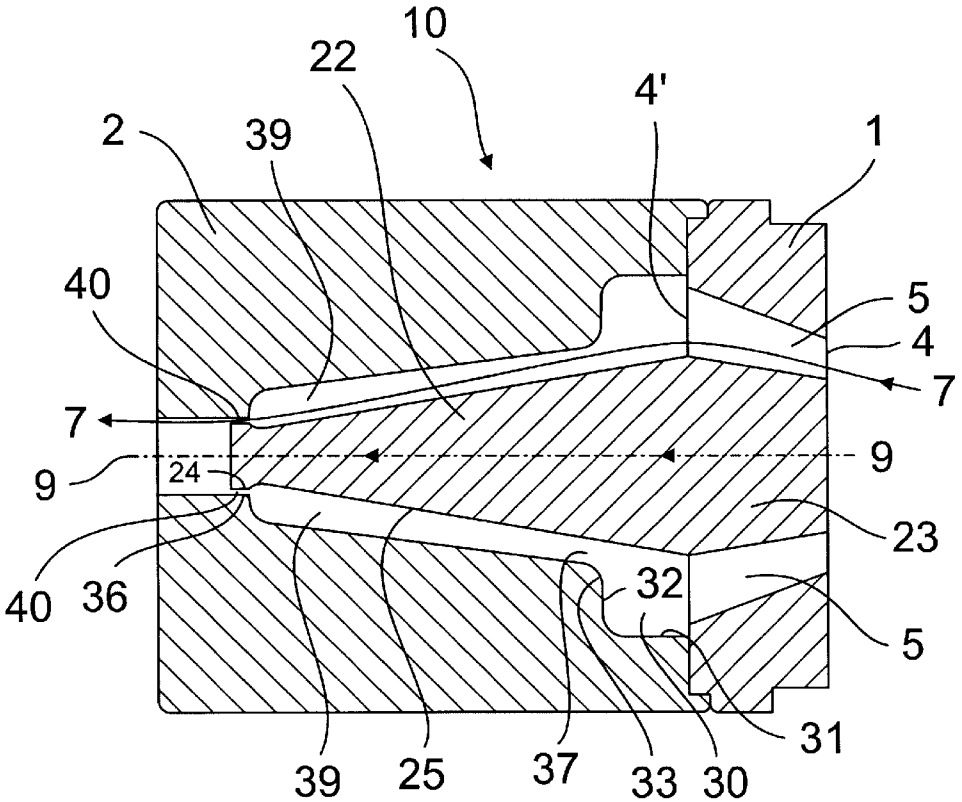
FIG. 13 is a sectional view through the center of an extrusion die set in accordance with the present invention.

With reference to FIG. 13, the mixing chamber 30 is further defined by the mixing extension 25 as an annular space in communication with the charge distribution passages outlets 4'. The diameter of the mixing chamber 30 is slightly larger than the diameter defined by the outlets 4' of the charge distribution passages 5. The end of the mixing chamber 30 opposite the charge distribution passage outlets 4' is defined by the compression surface 32 as is best seen in FIGS. 17 and 18. The compression surface 32 extends from the outside surface 31 to a compression shoulder 33. The compression surface is disposed at angle $\Phi$ to a plane perpendicular to the central axis 9. The annular compression shoulder 33 and the adjacent surface of the mixing extension 25 define an annular exit 37 from the mixing chamber 30 in the process direction. The annular exit 37 has a cross sectional area (measured perpendicular to the axis 9) approximately 25% of the cross sectional area of the mixing chamber 30.

The forming die 2 defines a mixing cone 34 extending from the compression shoulder 33 to a forming ring 36. The inside diameter of the mixing cone 34 tapers at a constant rate from the compression shoulder 33 in the process direction to a forming ring 36. As a result of this constant taper, the inside surface 38 of the mixing cone 34 is disposed at an angle $\gamma$ with respect to the central axis 9. The forming ring 36 defines the external configuration of the extruded product (not illustrated). In the illustrated embodiment, the forming ring 36 is a circular cylindrical surface substantially parallel to the central axis 9.

As is best seen in FIG. 13, angle $\gamma$ is less than angle $\beta$, resulting in a mixing space 39 having constantly variable dimensions in the process direction. The mixing space 39 terminates in an extrusion orifice 40 defined between the mandrel 24 and the forming ring 36.

The configuration of the extrusion die set 10 will now be described with respect to a billet of metal (not illustrated) being forced through the die set in the process direction. In the process direction, the billet will first encounter the three charging die inlets 4. Pressure provided by the ram of the extrusion press (not illustrated) will force the billet to divide in three parts, each part passing through one of the charge distribution passages 5.

The angularly offset and continuously variable configuration of the charge distribution passages 5 induce a counterclockwise rotational motion in each of the three charge portions. The three charge portions enter the mixing chamber 30 where the extra space provided by the mixing chamber's enlarged outer diameter permit the three portions of the charge to continue their counterclockwise motion until the mixing chamber is filled. The three charge portions then encounter the angled pressure surface 32 and pressure shoulder 33 where they are forced under high pressure to blend together before passing through the restricted annular exit 37. The angled orientation of the pressure surface 32 guides the charge portions toward the annular exit 37. Upon passing through the annular exit 37, the three distinct charge portions have now been at least partially combined to form a single extrusion charge.

The now at least partially blended extrusion charge is forced under pressure along the constantly variable internal configuration of the mixing space 39. The counterclockwise motion induced by the charge distribution passages 5 acts in concert with the constantly varying internal configuration of the mixing space 39 to continue the blending process. At the end of the mixing space 39 the now thoroughly blended extrusion charge encounters the extrusion orifice 40, another zone of high pressure. At the extrusion orifice 40 the extrusion charge is forced between the mandrel 24 and the forming ring 36 to form a seamless tubular extrusion in a shape defined by the space between the mandrel 24 and the forming ring 36.

The inventive configuration of the charge flow passage 7 through the die set 10 imparts rotational and angular flow forces to the extrusion charge which combine the once separate charge portions so thoroughly that the extruded product can be considered seamless. Furthermore, since the tubular product is extruded and not cast, all of the crystalline and dimensional defects inherent in cast tubular products are not found in the seamless extruded product.

Figure 20:
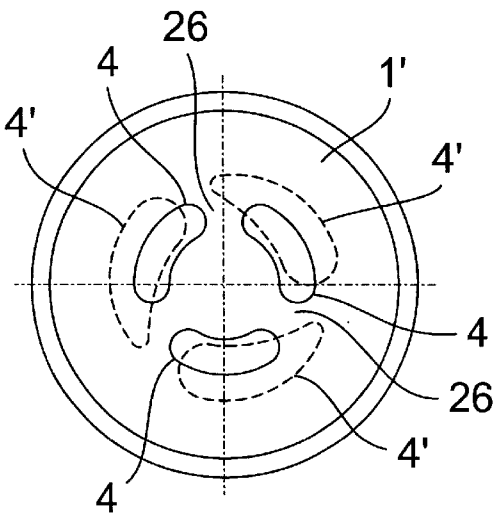
FIG. 20 is an end view, partially in phantom, of the extrusion die set of FIG. 19 turned 90° to the left.
Figure 19:
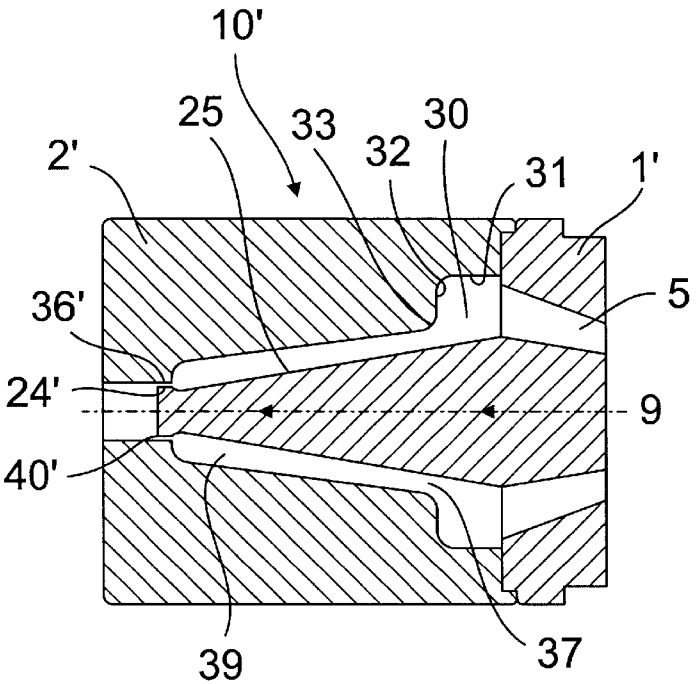
FIG. 19 is a sectional view through the center of an alternative extrusion die set in accordance with the present invention.
Figure 21:
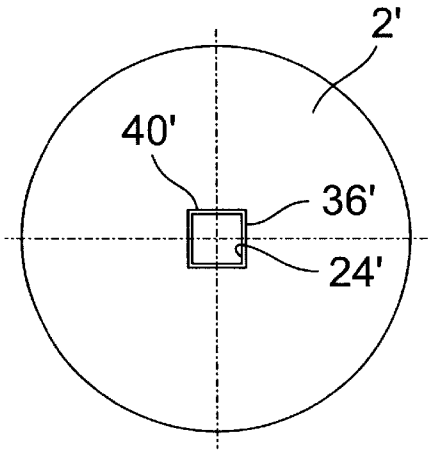
FIG. 21 is an end view, partially in phantom, of the extrusion die set of FIG. 19 turned 90° to the right.

The illustrated die set has a substantially cylindrical outer profile and is internally configured to produce a hollow extruded product having a circular cross section. FIGS. 19–21 illustrate an alternative die set 10' configured to produce a square extruded product. The charging die 1' and forming die 2' are substantially identical to those of die set 10. The internal configurations and principles of operation are also substantially identical except for the shape of the forming ring 36' and the mandrel 24'. These have a square shape and together define a square extrusion orifice 40'.

While preferred embodiments of the foregoing invention have been set forth for purposes of illustration, the foregoing description should not be deemed a limitation of the invention herein. Accordingly, various modification, adaptations and alternatives may occur to one skilled in the art without departing from the spirit and the scope of the present invention.

What is claimed is:

1. An extrusion die set for use in conjunction with a single cylinder horizontal extrusion press which forces a billet of metal through said die set in an extrusion direction, said die set comprising:

a charging die comprising:

a plurality of separate substantially identical charge distribution passages symmetrically arranged around a central axis, each said charge distribution passage traversing an arcuate path from an inlet to an angularly offset outlet;

a mixing extension axially projecting in the extrusion direction and at least partially surrounded at a charging end by said charging passages; and a mandrel integrally connected to said mixing extension, and a forming die defining an axial opening leading in the extrusion direction to a forming ring, said forming die configured to mate with said charging die and receive said mixing extension and mandrel to determine an axially continuous, substantially tubular charge flow passage comprising:

an annular mixing chamber in communication with said charge distribution passage outlets, said mixing chamber having a radial dimension and terminating in the extrusion direction in an annular exit having a radial dimension substantially less than the radial dimension of the mixing chamber;

a mixing space defined between said mixing extension and said forming die beyond said annular exit in the extrusion direction, said mixing space in communication with said annular exit, said mixing extension and said forming die being configured so that said mixing space has a continuously variable internal configuration in the extrusion direction; and an extrusion orifice defined between said forming ring and said mandrel, said extrusion orifice in communication with said mixing space.

2. The extrusion die set of claim 1, wherein said die set has a longitudinal axis and said charge distribution passages are disposed at an angle $\alpha$ with respect to said axis so that said charge distribution passage outlets are radially farther from said axis than said charge distribution passage inlets.

3. The extrusion die set of claim 2, wherein said angle $\alpha$ is in the range of 30°–35°

4. The extrusion die set of claim 1, wherein said die set has a longitudinal axis, said mixing extension includes an exterior mixing surface extending between said charge distribution passage outlets and said mandrel and said mixing extension tapers at a constant rate from a maximum diameter adjacent said charge distribution passage outlets to a minimum diameter adjacent said mandrel so that said mixing surface forms an angle $\beta$ with respect to said axis.

5. The extrusion die set of claim 4, wherein said angle $\beta$ is in the range of 7°–8°.

6. The extrusion die set of claim 1, wherein said die set has a longitudinal axis, said forming die includes a pressure surface extending from an outside surface of said mixing chamber to an annular pressure shoulder that defines a radially outward limit of said annular exit and said forming die includes a frustoconical inside surface extending from a maximum diameter adjacent said pressure shoulder to a minimum diameter adjacent said forming ring, said inside surface disposed at an angle $\gamma$ with respect to said axis.

7. The extrusion die set of claim 6, wherein said angle $\gamma$ is in the range of 9°–10°.

8. The extrusion die set of claim 6. Wherein said pressure surface is disposed at an angle of 3° with respect to a perpendicular to said axis.

9. The extrusion die set of claim 1, wherein each said charge distribution passage has a length and a cross sectional configuration perpendicular to said axis, said cross sectional configuration being continuously variable in the extrusion direction, said cross sectional configuration having a larger area at said outlet than at said inlet.

10. The extrusion die set of claim 1, wherein said die set has a longitudinal axis, said mixing extension includes an exterior mixing surface extending between said charge distribution passage outlets and said mandrel and said mixing extension tapers at a constant rate from a maximum diameter adjacent said charge distribution passage outlets to a minimum diameter adjacent said mandrel so that said mixing surface forms an angle $\beta$ with respect to said axis, and said forming die includes a pressure shoulder that defines a radially outward limit of said annular exit and said forming die includes a frustoconical inside surface extending from a maximum diameter adjacent said pressure shoulder to a minimum diameter adjacent said forming ring, said inside surface disposed at an angle $\gamma$ with respect to said axis, wherein said mixing space is defined between said mixing surface and said inside surface and said angle $\gamma$ is less than said angle $\beta$.

11. The extrusion die set of claim 1, wherein each said charge distribution passage outlet has a radially outer limit located a first radial distance from said axis and said mixing chamber has a radially outer limit located a second distance from said axis, said second distance being greater than said first distance.

12. The extrusion die set of claim 1, wherein said mixing chamber and said annular exit have cross sectional areas measured perpendicular to said axis and the cross sectional area of said annular exit is approximately 25% of a maximum cross sectional area of said mixing chamber.

13. A method for extruding a seamless hollow product from a solid billet through an extrusion die set in an extrusion direction on a single cylinder horizontal extrusion press, said die set having a said method comprising:

dividing said billet into a plurality of charge portions;

imparting a rotational component to a movement of said charge portions in the extrusion direction;

combining said charge portions into a single extrusion charge by forcing said charge portions through a first zone of high pressure in the extrusion direction;

blending said charge portions by forcing said extrusion charge through a mixing space having a continuously variable configuration in the extrusion direction; and extruding said hollow product through an extrusion orifice defined between a mandrel and a forming ring.

14. The method of claim 13, wherein said step of imparting comprises forcing each said charge portion through a charge distribution passage having an outlet angularly offset from an inlet.

15. The method of claim 13, wherein said step of combining comprises forcing said charge portions through a mixing chamber having a first cross sectional area measured perpendicular to said axis, said mixing chamber having an annular exit in the extrusion direction, said annular exit having a second cross sectional area measured perpendicular to said axis, said second cross sectional area being approximately 25% of the cross sectional area of said mixing chamber.

* * * * *